US005957307A

United States Patent [19]

Schulz

[11] Patent Number: 5,957,307

[45] Date of Patent: Sep. 28, 1999

[54] CODING STATION FOR A MAIL SORTING SYSTEM

[75] Inventor: Volkmar Schulz, Schwarzenbruck, Germany

[73] Assignee: Siemens Aktiengesellschaft, Munichen, Germany

[21] Appl. No.: 08/860,210

[22] PCT Filed: Jul. 13, 1995

[86] PCT No.: PCT/DE95/00931

§ 371 Date: Nov. 11, 1997

§ 102(e) Date: Nov. 11, 1997

[87] PCT Pub. No.: WO96/22164

PCT Pub. Date: Jul. 25, 1996

[30] Foreign Application Priority Data

Jan. 18, 1995 [DE] Germany ..... 195 01 654

[51] Int. Cl.[6] ..... B07C 5/00

[52] U.S. Cl. ..... 209/630; 209/703; 209/705; 209/942

[58] Field of Search ..... 209/702, 703, 209/704, 705, 942, 546, 630, 900

[56] References Cited

U.S. PATENT DOCUMENTS

| | | | |
|---|---|---|---|
| 1,869,150 | 7/1932 | Jackson | 209/703 |
| 2,564,185 | 8/1951 | Bailey | 209/703 X |
| 3,952,874 | 4/1976 | Owen | 209/705 X |
| 4,891,088 | 1/1990 | Svyatsky | 209/900 X |

FOREIGN PATENT DOCUMENTS

| | | | |
|---|---|---|---|
| 0 121 247 | 10/1984 | European Pat. Off. . | |
| 2 372 659 | 6/1978 | France . | |
| 4120155 | 12/1992 | Germany | 209/705 |

OTHER PUBLICATIONS

Evans et al., "An Easy–View Letter–Coding Desk," 8076 Post Office Electrical Engineers' Journal, vol. 71, No. 2 (Jul. 1978), 6 pages.

AEG, Universal Sortier System für Lang– und Grossbriefe, no date, 3 pages.

*Primary Examiner*—David H. Bollinger
*Attorney, Agent, or Firm*—Kenyon & Kenyon

[57] ABSTRACT

A letter coding station for a mail sorting system. In order to ensure good ergonomics when coding letters at a coding location, letters which are to be separated and coded are brought in stacks, via a first conveying section, to the operator. The operator can thereafter feed letters individually, in the conveying direction, to a further conveying section. The first conveying section aligns the letter stacks by a lectern-like arrangement such that the top side of the letter stacks which are to be separated is aligned approximately perpendicularly with respect to the viewing direction of the operator, while the operator is oriented obliquely to the a table of the coding station. This arrangement allows for a comfortable position of both arms, and allows the operator a good view of the letters being coded.

6 Claims, 2 Drawing Sheets

CODING STATION FOR A MAIL SORTING SYSTEM

BACKGROUND OF THE INVENTION

1. Field of the Invention

The present invention relates to a coding station for a mail sorting system, having a first conveying section, in particular a conveying belt, conveying letter stacks to a working area within the view and reach of a seated operator. The operator inputs codings with his or her right hand via a coding unit and can feed the letters individually, in the conveying direction, to a further conveying section.

2. Description of the Prior Art

A coding station is shown, for example, in the brochure "Universal Sortier System für Lang- und Groβbriefe" (Universal Sorting System for Long and Large Letters) order No. AEC/M33.7.148/0694 DE, by the company AEG. The items which are to be sorted, i.e. the long and large letters, are fed in stacks, from the right, to an operator who performs the manual coding with his or her right hand and uses his or her left hand to convey further the letters which are to be separated. The letter stacks are transported via a horizontally running conveying section. This results in the operator having to view the letters which are to be obliquely, in each case. Furthermore, the angle through which the letters which are to be separated have to be pivoted in order to be fed in to the further feeding section of the system is relatively large.

Lectern-like conveying sections in distributing machines for flat articles, in particular mail, are shown in the publication TOP "Verteilmaschine für flache Sendungen" by the company CEGELEC CGA. In this known distributing machine, however, the respective feeding directions are quite different from those in the present invention.

SUMMARY OF THE INVENTION

The object of the present invention is to design a coding station so that handling which is extremely favorable in terms of ergonomics is made possible.

This object is achieved according to the present invention in that the first conveying section is arranged in a lectern-like manner, such that the top side of the letter stack which is to be separated in each case is aligned approximately perpendicularly with respect to the viewing direction of the operator.

A first advantageous feature of the present invention is that the edge of a level table in front of the operator is aligned obliquely with respect to the conveying direction for the letter stacks. The left hand of the operator, which can rest on the table by way of the left forearm, can be placed in a relaxed position relatively close to the left of the letter stack which is to be separated. The right hand of the operater, which can rest by way of the right forearm or at least the ball of the thumb of the right hand, can be placed in a relaxed position in the vicinity of a coding keyboard on the table in front of the first conveying section. The slight oblique positioning of the operator in front of the conveying section thus ensures that the movements of each hand are equally close to the body. The operating comfort is increased further by the edge being provided with padding.

A further advantageous feature of the present invention is that a display for acknowledgement messages is arranged within the view of the operator. This display, which is preferably positioned above the stacks, can give an optical display of communications regarding the information which has been input or acknowledgement messages regarding system states.

A contactless sensor can be used to sense the completion of the operation for separating the letter stack which is to be separated in each case. Thereafter the next letter stack which is to be separated can be conveyed up by the first conveying section, which conveying operation can be automated. The operator is saved the task of performing any actuating operations. The sensors used may be contactless proximity switches.

Since the coding station is arranged on a platform, having a height corresponding approximately to the difference in height between a seated individual and a standing individual, straightforward manual charging of the first conveying section with letter stacks can take place via passageways.

BRIEF DESCRIPTION OF THE DRAWINGS

An exemplary embodiment of the invention is explained in more detail hereinbelow and is illustrated in the drawing, in which.

DETAILED DESCRIPTION OF THE INVENTION

Figure 1:
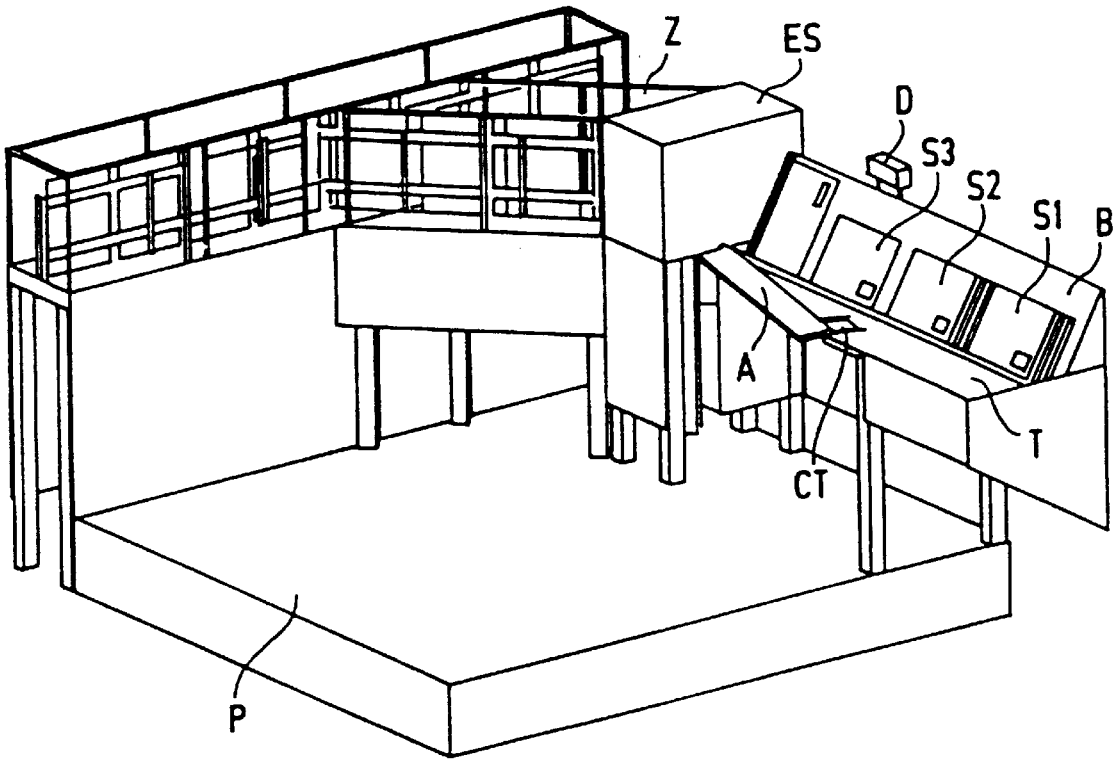
FIG. 1 shows a three-dimensional view of a coding station.

The illustration of FIG. 1 is a perspective illustration of a coding station for large letters, as can be used in a mail sorting system. In order to ensure a clear overview of the technical equipment, the operator and his or her seat are not shown in this illustration. The operator would be seated in front of a table T. The front side of table T is provided with an arm rest A which can support the operator's forearms or wrists. The letters, in particular large letters, which are to be coded flow as described below. The letters which are to be coded are set down in stacks on a first conveying section, in this case a belt B, of the coding station. The manner in which the letters are stacked for the sake of clarity, is not shown, and is done, for example, by other members of the staff. In the exemplary embodiment, three stacks S1, S2 and S3 are set down on the first conveying section. The stack S3 located in the immediate working area in front of the operator is then separated in each case by the operator. During separation, the uppermost letter in each case is usually turned to the left (counterclockwise) 90°, and fed into a feeding section Z via an input station ES., the system is informed of the respective address of the letter via a coding keyboard CT. The operator actuates the coding keyboard CT with his or her right hand in each case, while the left hand is used for turning the respective letter and feeding it into the feeding section Z.

Acknowledgement messages from the system, be these direct acknowledgement messages from the coding which has been input or other system communications, are shown via a display D, which is provided above the belt B within the view of the operator.

The seat of the coding-station operator is located on a platorm P, the height of which is such that it takes into account, approximately, the differences in height between a seated individual and a standing individual. This means that it is possible to sit down to work in the coding station, while letter stacks can be set down on the belt B by staff who are standing.

Figure 2:
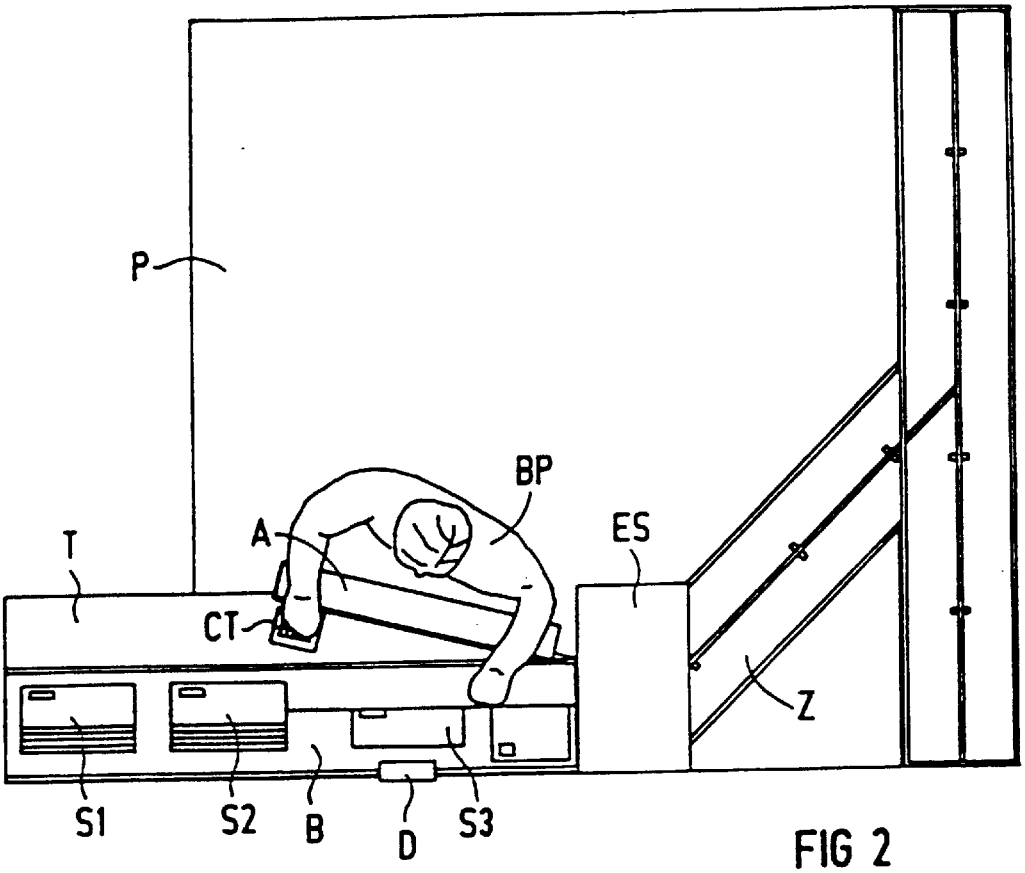
FIG. 2 shows a plan view of the coding station.

The illustration of FIG. 2 is a plan view of the coding station. The operator BP is shown in this case, and this illustration gives a particularly good indication of the slight oblique positioning of the operator BP with respect to both the front edge of the table T and the feeding direction of the belt B. This oblique positioning makes it possible for the left hand, which rests on the table T by way of the left forearm of the operator BP, to be placed in a relaxed position relatively close to the left of the letter stack S3 which is to be separated, the right hand, which can rest by way of the right forearm or at least the ball of the thumb of the right hand, to be placed in a relaxed position in the vicinity of the coding keyboard CT on the table T in front of the belt B. The movements which are to be carried out may then be made in an ergonomically favorable manner.

Figure 3:
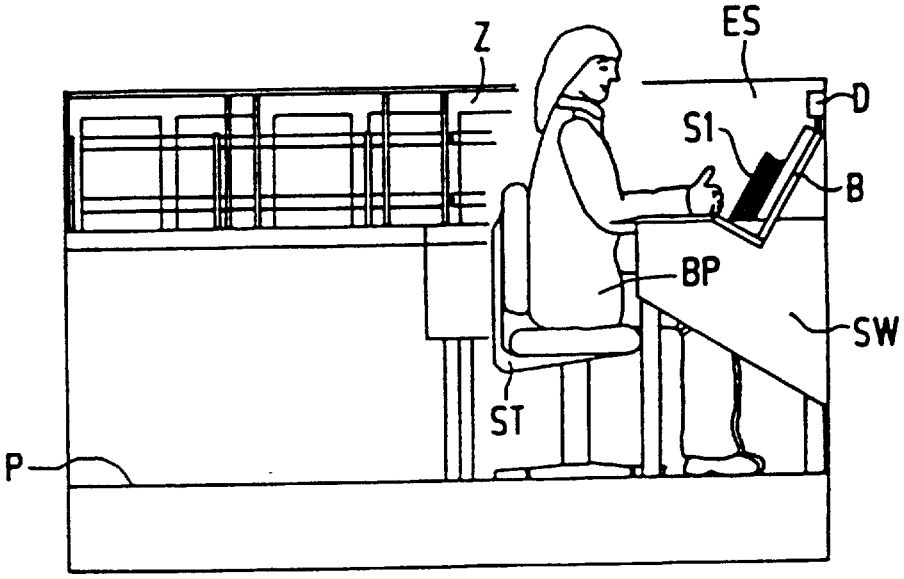
FIG. 3 shows a side view of the coding station.

The illustration of FIG. 3 shows a side view of the coding station, in which the same elements as in the previously described figures are, of course, provided with the same designations. It can be seen particularly well from this illustration that the knee area of the operator BP is protected by a side wall SW. The material of the side wall SW is designed such that it does not cause cold to be carried away from the body, which could subject the operator to much discomfort. The side view of the belt B shows that this conveying device for the stacks S1 to S3 has L-shaped main dimensions, it being possible, depending on the configuration, for the belt B to span one leg and/or both legs of the "L". Of course, it is possible, in particular when only one leg of the "L" is spanned in each case, for separate carriers to be provided on the belt B as supports or trays for the stacks S1 to S3.

The fact that the operator BP in each case removes one letter from the stack S3 and provides it with coding via the coding keyboard CT, and then thereafter feeds it in a defined manner, via the input station ES, into the feeding section Z with its defined compartments, always ensures agreement between items and coding for the sorting operation.

In the exemplary embodiment illustrated, the letter stacks S1 to S3 have been fed to the working area of the operator from the right. This has the advantage that the view of the next stack is not concealed by the left hand or the left arm when the current stack is pushed on to the further conveying section by the left hand. This allows the operator to focus on the address area of the following stack without any obstruction. However, the invention is also effective when the conveying direction runs from left to right.

What is claimed is:

1. A coding station for a mail sorting system, in which a letter stack which is to be separated is brought within the view and reach of an operator, the coding station comprising:

a table;

a first conveying station, the first conveying station comprising a conveyor, the letter stack being fed to the operator by the conveyor, the conveyor comprising a conveying direction, the conveying direction being oriented obliquely with respect to the table, a top side of the letter stack being aligned approximately perpendicularly with respect to a viewing direction of the operator, a portion of the first conveying station defining a letter-gripping location, the letter-gripping location being within the reach of a hand of the operator;

a coding unit, the coding unit allowing coding of information regarding a particular letter, the coding unit being within the reach of another hand of the operator, the coding unit being provided on the table in front of the operator, the coding unit defining a coding location;

whereby the location of the letter-gripping location and to the coding location are oriented to allow the hands of the operator to be placed in equally relaxed positions.

2. The coding station of claim 1, wherein:

an edge of the table comprises padding.

3. The coding station of claim 1, further comprising:

a display providing messages, the display being arranged within view of the operator.

4. The coding station of claim 1, further comprising:

a sensor, the sensor sensing completion of an operation on the letter stack, the sensor sending a signal to convey a newsletter stack by the conveyor.

5. The coding station of claim 1, wherein:

the coding station is arranged on a platform, a height of the platform corresponding approximately to a difference in height between a seated individual and a standing individual.

6. The coding station of claim 1, wherein:

the conveyor feeds the letter stack to the letter-gripping location from the right.

* * * * *